US008680952B2

(12) United States Patent
Erb

(10) Patent No.: US 8,680,952 B2
(45) Date of Patent: Mar. 25, 2014

(54) BANDPASS FILTER WITH DUAL BAND RESPONSE

(75) Inventor: Jean-Luc Erb, Horbourg-Wihr (FR)

(73) Assignee: TDK Corporation, Tokyo (JP)

( * ) Notice: Subject to any disclaimer, the term of this patent is extended or adjusted under 35 U.S.C. 154(b) by 1138 days.

(21) Appl. No.: 12/346,596

(22) Filed: Dec. 30, 2008

(65) Prior Publication Data

US 2010/0164651 A1 Jul. 1, 2010

(51) Int. Cl.
*H01P 1/203* (2006.01)
*H01P 7/08* (2006.01)

(52) U.S. Cl.
USPC ..... 333/204; 333/219

(58) Field of Classification Search
USPC ..... 333/176, 175, 185, 204, 205, 219, 235
See application file for complete search history.

(56) References Cited

U.S. PATENT DOCUMENTS 4,992,759 A * 2/1991 Giraudeau et al. ..... 333/204
5,455,545 A * 10/1995 Garcia ..... 333/26
6,140,891 A * 10/2000 Nakakubo et al. ..... 333/204
6,603,372 B1 * 8/2003 Ishizaki et al. ..... 333/204
7,116,186 B2 * 10/2006 Chen ..... 333/126
7,782,157 B2 * 8/2010 Oshima ..... 333/185
2001/0050599 A1 * 12/2001 Maekawa et al. ..... 333/134
2002/0158717 A1 * 10/2002 Toncich ..... 333/202
2004/0246071 A1 * 12/2004 Rottmoser et al. ..... 333/134
2008/0100401 A1 * 5/2008 Cho et al. ..... 333/204

* cited by examiner

*Primary Examiner* — Benny Lee
*Assistant Examiner* — Gerald Stevens
(74) *Attorney, Agent, or Firm* — Allen J. Moss; Squire Sanders (US) LLP

(57) ABSTRACT

There is provided an improved bandpass filter having multiple passbands, and in one embodiment, two independent passbands are provided by a single filter. Embodiments of the present invention support communication architectures with several frequency bands without requiring one signal path per band, thus realizing improvements in size, cost, and weight. One aspect of the invention utilizes strongly overcoupled resonators to achieve multiple passband response, and in various embodiments, single-ended or differential mode inputs and outputs are accommodated.

16 Claims, 13 Drawing Sheets

BANDPASS FILTER WITH DUAL BAND RESPONSE

DESCRIPTION OF THE INVENTION

1. Field of the Invention

The present invention relates to electronic bandpass filters, and more specifically to a bandpass filters with multiple (e.g. dual) passband response.

2. Background of the Invention

Market forces have continued to drive the evolution of complex communication devices to ever higher performance and reliability standards with the somewhat paradoxical goals of smaller device sizes and lower costs. Particularly, communication devices are increasingly utilizing multiple communication frequencies and standards, and therefore electronic components that are capable of efficiently supporting multiple standards without duplicative hardware are needed. For example, communications devices with integrated RF transceivers are presently being fabricated where the devices are capable of operating with both global system for mobile communications (GSM) and wireless code-division multiple-access (WCDMA) protocols. Further, dual-band antennas are being utilized for receiving signals at 900/1800 MHz (e.g., GSM) and at 2.4/5.2 GHz (e.g. WiFi/ISM), and dual-frequency rectennas have been developed for wireless power transmission.

Hardware that supports multiple frequency operation must also condition signals that operate in diverse frequencies. Such signal condition may include, for example, suppressing noise or other undesired signals outside of the desired operational bands. However, design of components such as filters with multiple passband response has presented a significant challenge. A variety of approaches have been used such as stepped-impedance resonators and hairpin resonators, but solutions utilized thus far have significant limitations due to size and frequency ratio between the design resonances. Alternatively, approaches such as double-diplexing configurations have been used, where signals are split before being presented to two filters and re-combined at the output, and further, several sections of lumped components have been utilized. However, lumped component approaches are lossy in stripline transmission environments and operate suboptimally at high frequencies, and differential inputs are not supported without a significant increase in size of the designed filter. What is needed then is a passband filter design that provides for dual passband operation that scales with frequency and can accommodate differential inputs with little or no space penalty. What is further needed is a dual passband filter that may utilize a micro strip, stripline or other architecture and may include resonators in a variety of configurations, including differential input modes.

SUMMARY OF THE INVENTION

In view of the foregoing, there is provided an improved bandpass filter having multiple passbands, and in one embodiment, two independent passbands are provided by a single filter. Embodiments of the present invention support communication architectures with several frequency bands without requiring one signal path per band, thus realizing improvements in size, cost, and weight.

Implementations of the present invention achieve dual passband performance by utilizing overcoupled resonators (particularly transverse electromagnetic (TEM) quarter-wave resonator or quasi TEM resonators in multiplayer substrates), for example where one or more inter-resonator couplings are stronger than a critical coupling. Unlike standard electromagnetic coupling or quasi-lumped capacitor coupling between resonators in RF substrates (LTCC, GaAs, MLO, Si, other), direct coupling between resonators using transmission lines (whose electrical length is small compared to a quarter-wave) creates a passband profile with distinct passband regions, for instance two passband regions in a particular implementation. Normally, this effect is unwanted in standard filter design, but by tapping resonators in a predetermined proximity to the grounded end, this feature can be manipulated to produce a desired dual passband. Depending on the location of the coupling with respect to a ground point, the resulting coupling may become weaker and weaker as resonators are tapped closer to the ground point, eventually reaching critical coupling.

In one embodiment, resonators are overcoupled directly (e.g., no capacitive gap, no inductive coil) through a transmission line between any two points of the resonators. The length of the transmission line must be short in comparison to a quarter wave line.

In a dual-band implementation of a multi-passband filter, the filter includes two or more transmission lines forming resonators, with a source and load connected to the filter at any desired location. The resonators include strong couplings between them to achieve various passband configurations in accordance with embodiments of the invention. The couplings, for example, may include a low reactance element creating very strong over-coupling between the resonators with or without additional components in parallel with this coupling component. In one embodiment, the coupling element is preferably a transmission line whose electrical length is small compared to a quarter wave, and may begin and/or end at any point between the open end and short-circuit end of a resonator. The coupling could also be an inductor, provided that lossy characteristics and frequency dependence do not prevent realization of the desired passband performance without creating undesired impacts on filter circuit size. Further, the coupling between resonators could also be a large capacitor, also provided that size and frequency dependence are acceptable within design tolerances.

Aspects of the present utilize purposeful overcoupling (stronger than electromagnetic mistuning, stronger than lumped element J-inverter approximation) to achieve a particular goal: derive with great flexibility (no relationship to resonator geometry or harmonics) multiple passbands as the product of resonator inter-coupling. The multiple passbands can in this case be more than an octave apart. An extension of the concept is that more than two passbands can be achieved by using more than two resonators.

In one embodiment, a dual-band filter is provided that includes a substrate; and first and second resonators disposed within the substrate, each of the resonators respectively having an open circuit end and a short circuit end; wherein the first and second resonators are connected through a low-reactance inter-resonator coupling, the inter-resonator coupling configuring the filter to provide dual-band response. The low-reactance inter-resonator coupling component may further comprise at least one of: a transmission line substantially shorter than a quarter wavelength, an inductor; a capacitor; and a resistor. The low-reactance inter-resonator coupling component may be coupled between the first and second resonators at any predetermined location along the length of the first and second resonator. More than one coupling may be utilized; for example, two or more low-reactance inter-resonator coupling components may be connected to the resonators in parallel. The inter-resonator couplings are selected to be any type of electrical coupling that strongly overcouples the resonators, which in various embodiments may include transverse electromagnetic quarter-wave resonators.

The resonators of the filter in various embodiments may be configured in any desired configuration such as a combline resonator, an interdigital resonator, and an edge-coupled resonator. For various design considerations such as to enhance or modify the resonance of compactly designed resonators, the resonators may be loaded by respective capacitors at the open circuit end, wherein each respective capacitor connects a respective resonator to ground. The resonators of the dual-band filter may be over-coupled at any location to achieve a particular filter response, such as at the short circuit end.

The substrate of various embodiments of the present invention may comprise any substance capable of providing structural support for the conductive elements of the filter circuit, and provides an appropriate dielectric medium. In various embodiments, the substrate may include at least one of a low temperature co-fired ceramic substrate (LTCC), a high temperature co-fired ceramic substrate, a silicon substrate, a gallium arsenide substrate, and an organic circuit substrate, and may include a multilayer structure. Other substrates may be used to satisfy various design parameters such as cost, size, and performance.

Embodiments of the present invention may be fabricated using LTCC substrates, and construction of such substrates is well known in the art. First, holes are first punched through green dielectric media to create vias through layers. Then, each via hole is filled with conductive material and layers are printed with appropriate pattern separately. All filled layers are stacked, laminated and co-fired at temperature between 800° C. and 900° C. into a compact ceramic structure. Through the fabrication process, passive components in addition to conductive traces may be embedded within the substrate. Ceramic materials used in LTCC possess stable dielectric constant within a large frequency range. For example, one common dielectric material 943-A5 has $7.6<\in r<7.8$ for 1 GHz$<f<$20 GHz. The dielectric of the substrate is chosen in consideration of design of components such as transmission lines and capacitors embedded within the substrate.

In various multilayer embodiments, various transmission line environments may be established for the resonators to achieve desired design goals. For example, first and second resonators may be disposed on the same layer within the multilayer structure, wherein at least one conductive plane on a disparate layer of the multilayer structure configures the circuit as a microstrip architecture. Further, a second conductive layer may also be utilized to configure elements of the filter circuit to operate in a stripline transmission environment. Choice of the various circuit architectures may be made a function of desired filter characteristics and circuit topology.

In various embodiments, one or more loading capacitors may be provided. The loading capacitors may comprise discrete components or may be fabricated from conductive planes and dielectric disposed within the substrate. In common high-performance thin-film substrates such as low-temperature cofired ceramic, the dielectric of the materials forming the bulk of the substrate material is suitable for use as a capacitor dielectric. Therefore, resonators of the filter may be respectively coupled to at least one loading capacitor formed by at least one top conductive plane disposed on a layer above the first and second resonators, where the at least one top conductive plane situated above at least one lower conductive plane disposed on a layer below the first and second resonators. The intervening substrate material forms a dielectric between the conductive planes that act as plate electrodes of the capacitor, and overall size of the filter is therefore minimized as circuit components such as resonators and couplings may be disposed between loading capacitor plates.

The inter-resonator couplings may comprise any coupling capable of providing strong over-coupling, and may include a common transmission line to ground, the common transmission line coupled between a common tapping of first and second resonators.

Any number of resonators may be utilized to achieve the desired design performance characteristics. In one embodiment, three resonators are disposed within the substrate, the third resonator having an open circuit end and a short circuit end; wherein: the first, second, and third resonators are connected through a low-reactance inter-resonator coupling, the inter-resonator coupling configuring the filter to provide dual-band response; the low-reactance inter-resonator coupling component comprises a common transmission line to ground, the common transmission line coupled between a common tapping of the first, second, and third resonators; the first, second and third resonators are respectively loaded by respective capacitors at the open circuit end, wherein each respective capacitor connects a respective resonator to ground; and a feedback capacitor is coupled between the open circuit ends of the first and third resonators. A feedback capacitor may be added to achieve various design performance goals such as further coupling between the resonators, and may be coupled in any desired manner such as between open circuit ends of at least two of first, second, and third resonators.

In another embodiment, a dual-band filter comprises a substrate; first and second resonators disposed within the substrate, each of the resonators respectively having an open circuit end and a merging end; wherein the first and second resonators are connected to a transmission line at their respective merging ends, the transmission line providing a strong inter-resonator coupling to configure the filter to provide dual-band response. The dual-band filter further includes coupling element coupled between the first and second resonators at any predetermined proximity to the either the open circuit end, or to the merging (or open-circuit) end, and in various embodiments, coupling proximate to the merging end is desired.

As mentioned previously, the coupling element may comprise any component capable of providing strong overcoupling, such as a capacitor, an inductor, or a short transmission line substantially shorter than a quarter wavelength. First and second resonators may comprise any appropriate resonator structures such as transverse electromagnetic quarter-wave resonators. The resonators may be configured in any desired manner, such as combline resonators, interdigital resonators, and edge-coupled resonators, and may be strongly overcoupled at any desired location. The first and second resonators may be further loaded by one or more capacitors, collectively or respectively, between the respective open circuit ends and ground.

In various embodiments, first and second resonators are disposed on the same layer within the multilayer structure; and the first and second resonators are respectively coupled to at least one loading capacitor formed by at least one top conductive plane disposed on a layer above the first and second resonators, the at least one top conductive plane situated above at least one lower conductive plane disposed on a layer below the first and second resonators. Additional embodiments may further comprise a third resonator disposed within the substrate and having an open circuit end and a merging end, the merging end connected to the transmission line, and a third loading capacitor coupled between the open circuit end of the third resonator and ground. A coupling element may also be coupled between two of the three resonators at their respective open circuit ends, and may comprise at least one of a capacitor and an inductor.

Various embodiments of the present invention may provide for single or differential input/output capabilities. In one embodiment of a differential aspect of the present invention, a filter comprises a substrate; a first input coupled to a first overcoupled resonator assembly disposed within the substrate and including a first plurality of resonators having a short circuit end and a merging end; a second input coupled to a second overcoupled resonator assembly disposed within the substrate comprising a second plurality of resonators having a short circuit end and a merging end; an output coupled to the first overcoupled resonator assembly; and wherein the first plurality of resonators are respectively disposed in vertically offset substantially parallel proximity to the second plurality of resonators. Put another way, a second assembly of resonators exists on a nearby layer to the first assembly of resonators, and are designed to configure the filter to provide multiple passband response while operating in differential mode. The second grouping of resonators appears proximate and symmetrical to the first grouping, with the exception of the strong coupling which may not be proximate between the first and second resonator assemblies. In this embodiment, the plurality of resonators of the first overcoupled resonator assembly are respectively connected at the merging end through a first low-reactance inter-resonator coupling; the plurality of resonators of the second overcoupled resonator assembly are respectively connected at the merging end through a second low-reactance inter-resonator coupling; and wherein the first and second inter-resonator couplings configure the filter to provide dual-band response.

The strong overcoupling between the first and second low-reactance inter-resonator coupling components respectively comprise at least one of: a transmission line substantially shorter than a quarter wavelength; an inductor; a capacitor; and a resistor, and the plurality of resonators of the first and second overcoupled resonator assemblies may respectively comprise transverse electromagnetic quarter-wave resonators. The resonators may be configured any desired manner, such as the plurality of resonators of the first and second overcoupled resonator assemblies respectively comprising one of a combline resonator, an interdigital resonator, and an edge-coupled resonator.

In an embodiment, the first overcoupled resonator assembly and the second overcoupled resonator assembly are respectively disposed on adjacent signal layers within a multilayer structure; the second overcoupled resonator assembly comprises substantially similar resonator dimensions and spacing as the first overcoupled resonator assembly; and the second overcoupled resonator assembly is disposed so as to be 180 degrees rotated about an axis perpendicular to the signal layers with respect to the first overcoupled resonator, wherein: the respective resonators of the first and second pluralites of resonators are respectively proximal and substantially parallel; and first and second low-reactance inter-resonator couplings are substantially removed from one another. A spatial arrangement of the first plurality of resonators may be substantially similar to a spatial arrangement of the second plurality of resonators. Further, a merging end of the first plurality of resonators is proximate to the short circuit end of the second plurality of resonators.

Any desired number of resonators may be utilized to achieve desired filter operation. In one embodiment, the first plurality of resonators includes two resonators and the second plurality of resonators comprises two resonators, and in another embodiment, the first plurality of resonators includes three resonators and the second plurality of resonators comprises three resonators. Additional resonators may be added to affect the number of desired passbands, filter response, or skirt configuration.

The differential inputs embodiment of the present invention may also support differential output, for example, a second output may be provided that is coupled to the second overcoupled resonator assembly.

The substrate of differential mode embodiments of the present invention may comprise any material capable of providing structural support for the conductive elements of the filter circuit, and provides an appropriate dielectric medium. In various embodiments, the substrate may include at least one of a low temperature co-fired ceramic substrate, a high temperature co-fired ceramic substrate, a silicon substrate, a gallium arsenide substrate, and an organic circuit substrate, and may include a multilayer structure. Other substrates may be used to satisfy various design parameters such as cost, size, and performance.

In various multilayer embodiments of the differential mode filter of the present invention, various transmission line environments may be established for the resonators to achieve desired design goals. For example, the first overcoupled resonator assembly and the second overcoupled resonator assembly may be respectively disposed on adjacent signal layers within the multilayer structure, wherein at least one conductive plane on a disparate layer of the multilayer structure configures the circuit as a microstrip architecture. Adjacent signal layers are separated by a predetermined distance based on the particular substrate design methodology, for example, approximately 20-40 μm. Further, a second conductive layer may also be utilized to configure elements of the filter circuit to operate in a stripline transmission environment. Choice of the various circuit architectures may be made a function of desired filter characteristics and circuit topology.

Loading capacitors may also be utilized with differential embodiments of the present invention. For example, the first overcoupled resonator assembly and the second overcoupled resonator assembly may be respectively disposed on adjacent signal layers within the multilayer structure; and the first and second overcoupled resonator assemblies may be respectively coupled to at least one loading capacitor formed by at least one top conductive plane disposed on a layer above the first and second resonators, the at least one top conductive plane situated above at least one lower conductive plane disposed on a layer below the first and second overcoupled resonator assemblies. The at least one loading capacitor may further comprise dielectric medium disposed between the top conductive plane and the loser conductive plane, the dielectric comprising ceramic substrate material, or any other desired dielectric material utilized in the fabrication of the substrate.

It is to be understood that the descriptions of this invention herein are exemplary and explanatory only and are not restrictive of the invention as claimed.

DESCRIPTION OF THE EMBODIMENTS

Reference will now be made in detail to the present exemplary embodiments of the invention, examples of which are illustrated in the accompanying drawings.

Figure 1:
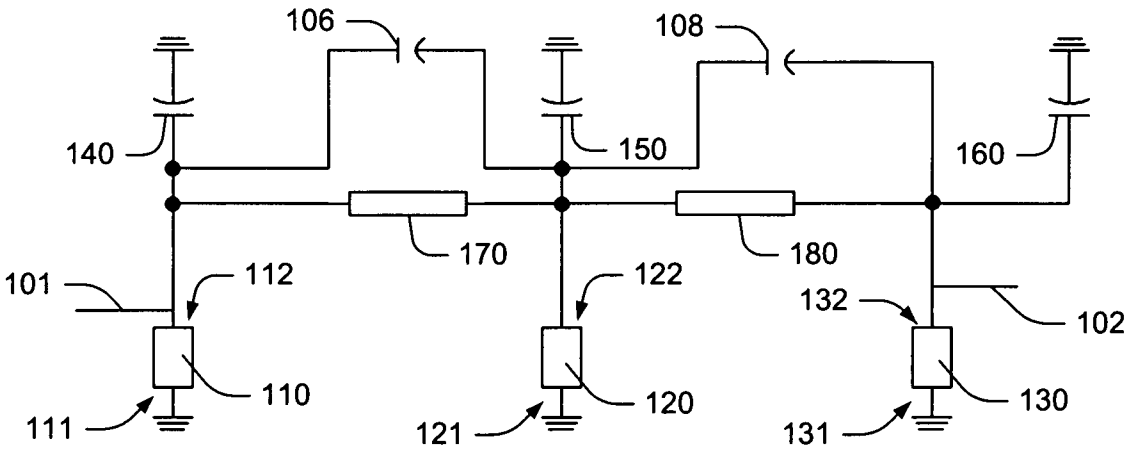
FIG. 1 illustrates a circuit schematic for an embodiment of dual-band filter of the present invention.
Figure 2:
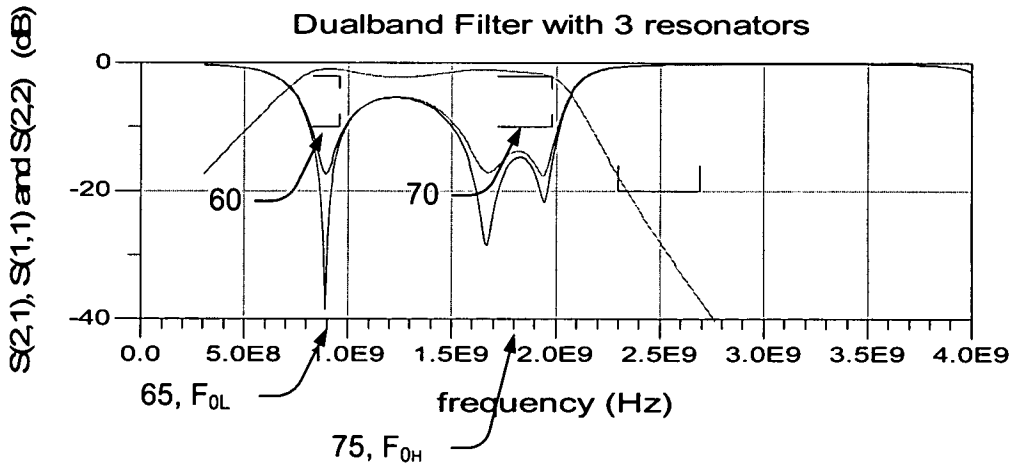
FIG. 2 illustrates a frequency response diagram of the circuit shown in FIG. 1.

A circuit schematic for a dual-band filter of the present invention may be seen in FIG. 1 with a corresponding frequency response diagram plotted in FIG. 2. The plotted S parameters of FIG. 2 show a dual-band bandpass filter response (60, 70) with center passband frequencies (65, 75) $f_{0L}$ and $f_{0H}$ of approximately 900 and 1800 MHz, respectively. This filter configuration would be useful, for instance, in GSM communications where frequencies outside of the 900 MHz and 1800 MHZ ranges interfere with communications signals.

The schematic of FIG. 1 comprises a filter configuration with three resonators 110, 120, and 130, with an input 101 coupled to the open circuit end 112 of resonator 110, and an output 102 coupled to the open circuit end 132 of resonator 130. Each of the three resonators 110, 120, 130 is in turn respectively coupled to ground at their short circuit ends 111, 121, 131. In one embodiment, the resonators 110, 120, 130 may comprise any appropriate resonator structures such as transverse electromagnetic quarter-wave resonators.

Two inter-resonator couplings 170, 180, provide strong overcoupling between the resonators 110, 120, 130. In one embodiment, the intra-resonator couplings comprise transmission lines, where the length of the transmission lines is short in comparison to the length of a quarter-wave line. Additional intra-resonator coupling elements such as capacitors 106, 108 (also known as feedback capacitors) are shown coupled respectively between resonators 110, 120 and 120, 130 and may be utilized to refine the frequency response characteristics of the dual-band filter. Components other than capacitors (inductors, for instance) may be utilized as inter-resonator coupling components depending on the desired frequency response of the filter. Loading capacitors 140, 150, and 160 are respectively connected between the open circuit ends 112, 122, 132 of the resonators 110, 120, 130 and ground. Among other functions, the loading capacitors help further reduce the size of the transmission lines needed to implement the resonators 110, 120, 130.

Figure 3:
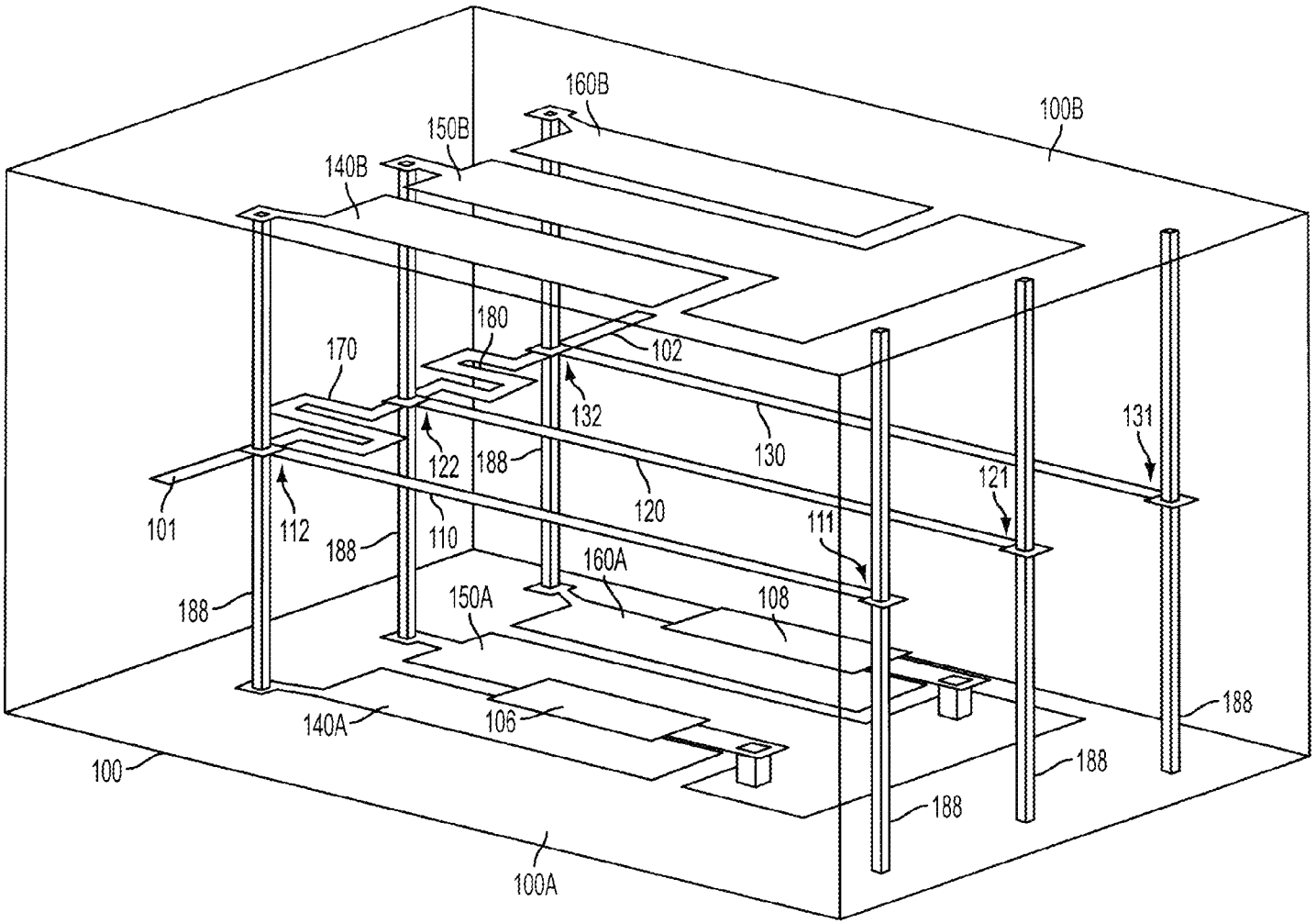
FIG. 3 shows a perspective view of an exemplary implementation of the schematic of FIG. 1 in a multilayer substrate.

FIG. 3 shows a perspective view of an exemplary implementation of the schematic of FIG. 1 in a multilayer substrate such as a low temperature cofired ceramic (LTCC) substrate. Layers of the substrates 100 depicted in several drawings are not shown for clarity, but are generally parallel to the bottom surface 100A and top surface 100B of the substrate 100. Conductive elements typically may be formed from silver, gold, copper, tungsten, and other metals and alloys, and comprise the conductive traces shown in the perspective substrate illustrations. In one implementation, layers may comprise any thickness of dielectric, any thickness of conductor, any thickness of dielectric with embedded conductors, or other elements. In one thin-film embodiment, spacing between layers may be in the range of 20-40 μm, but other dimensions are acceptable depending on substrate implementation technology. While the substrate 100 is shown with a rectanguloid exterior border outline, those of skill in the relevant arts recognize that the circuit depicted may be part of a larger substrate 100 that extends further in any x, y, or z direction.

The resonators 110, 120, and 130 are respectively formed from conductive transmission lines configured as transverse electromagnetic quarter-wave resonators residing on the same layer of the substrate 100. The short-circuit ends 111, 121, 131 of the resonators 110, 120, 130 are connected to conductive ground vias 188, shown as posts passing vertically through the substrate 100. Vias 188 are illustrative of connections to ground, for example to top/bottom ground planes. Ground connections could also be achieved through the use of side wall shielding, built-in coplanar shielding, or any other desired grounding configuration. An input 101 is coupled to the open circuit end 112 of resonator 110, and an output 102 is coupled to the open circuit end 132 of resonator 130. Each of the three resonators 110, 120, 130 is in turn respectively coupled to a ground vias 188 at the respective short circuit end 111, 121, 131. If desired, input 101 and output 102 may be interchanged.

A strong overcoupling is achieved through inter-resonator couplings implemented in FIG. 3 as serpentine transmission lines 170, 180. Both transmission lines are short compared to the length of a quarter wave line in this implementation. Inter-resonator coupling 170 couples between resonators 110 and 120, and inter-resonator coupling 130 couples between resonators 120 and 130.

Loading capacitors (FIG. 1 140, 150, 160) are coupled to the resonators 110, 120, 130 to minimize the size of the resonators required to achieve desired frequency response and to achieve other desired performance criteria. The loading capacitors (FIG. 1 140, 150, 160) are implemented respectively with conductive bottom plates 140A 150A 160A and conductive top plates 140B 150B 160C forming electrodes of capacitors. The material of the substrate provides a dielectric between the plates 140A 140B, 150A 150B, and 160A 160B defining the capacitors 140, 150, 160. A variety of dielectrics may be utilized to achieve the desired capacitance. The illustrated placement of the plates of the capacitors 140A 140B, 150A 150B, and 160A 160B around other circuit components such as the resonators 110, 120, 130 minimizes the size of the implemented multiband filter.

Two additional coupling capacitors (FIG. 1, 106, 108) are shown implemented in FIG. 3 through capacitors formed by plates 106A disposed in parallel to plate 140A and by plate 108A disposed in parallel with plate 160A. As mentioned above, the substrate material forms a dielectric between the respective capacitor plates.

Figure 4:
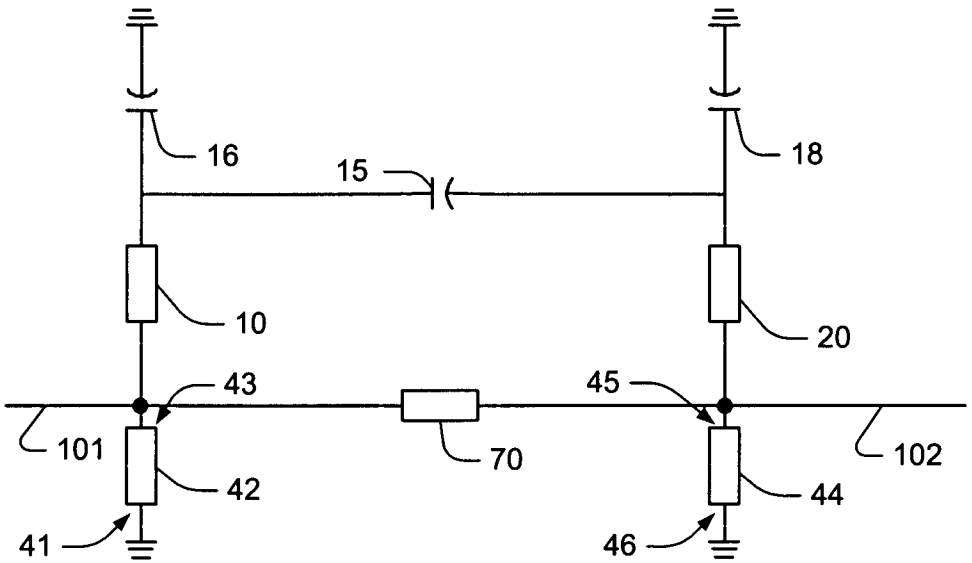
FIG. 4 illustrates a circuit schematic for another embodiment of dual-band filter of the present invention.
Figure 5:
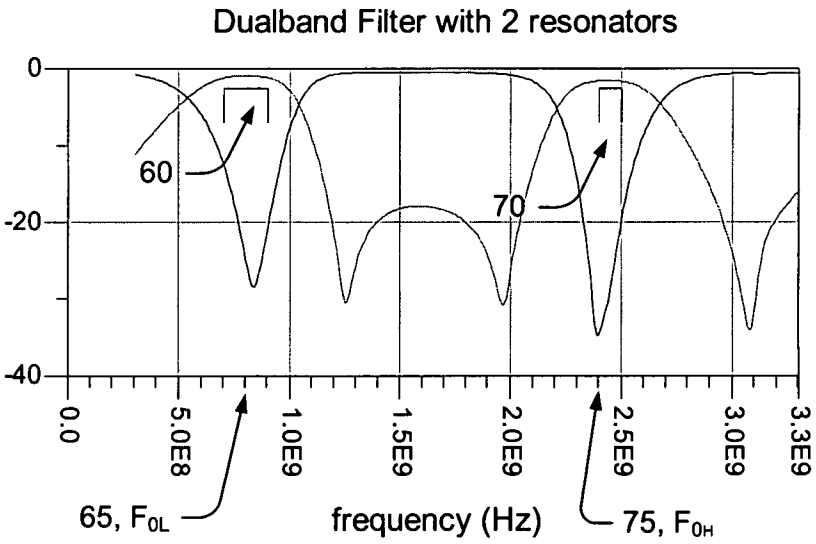
FIG. 5 shows a frequency response diagram for an exemplary implementation of the schematic of FIG. 4 in a multilayer substrate.

A variety of circuit topologies may be utilized to configure strongly overcoupled resonators to operate in a multiple passband response mode, and while three resonators were used for the previous example, the circuit in FIG. 4 illustrates a circuit schematic for another embodiment of dual-band filter of the present invention that uses two resonators. A corresponding a corresponding frequency response diagram obtained from simulation is illustrated in FIG. 5. The plotted S parameters of FIG. 5 show a dual-band bandpass filter response (60, 70) with center passband frequencies (65, 75) $f_{0L}$ and $f_{0H}$ of approximately 800 and 2400 MHz, respectively.

Turning to FIG. 4, input 101 is coupled to the open circuit end 43 of resonator 42, and output 102 is coupled to the open circuit end 45 of the resonator 44. The short circuit ends 41, 46 of resonators 43, 44 are grounded. A strong overcoupling component 70 is connected to the open circuit ends 43, 45 of the resonators 42, 43. Transmission lines 10, 20 respectively couple the open circuit ends 43 45 of the resonators 42, 44 to loading capacitors 16, 18. An additional coupling/feedback capacitor is also shown that is connected between the load capacitor ends of the transmission lines 10, 20.

Figure 6:
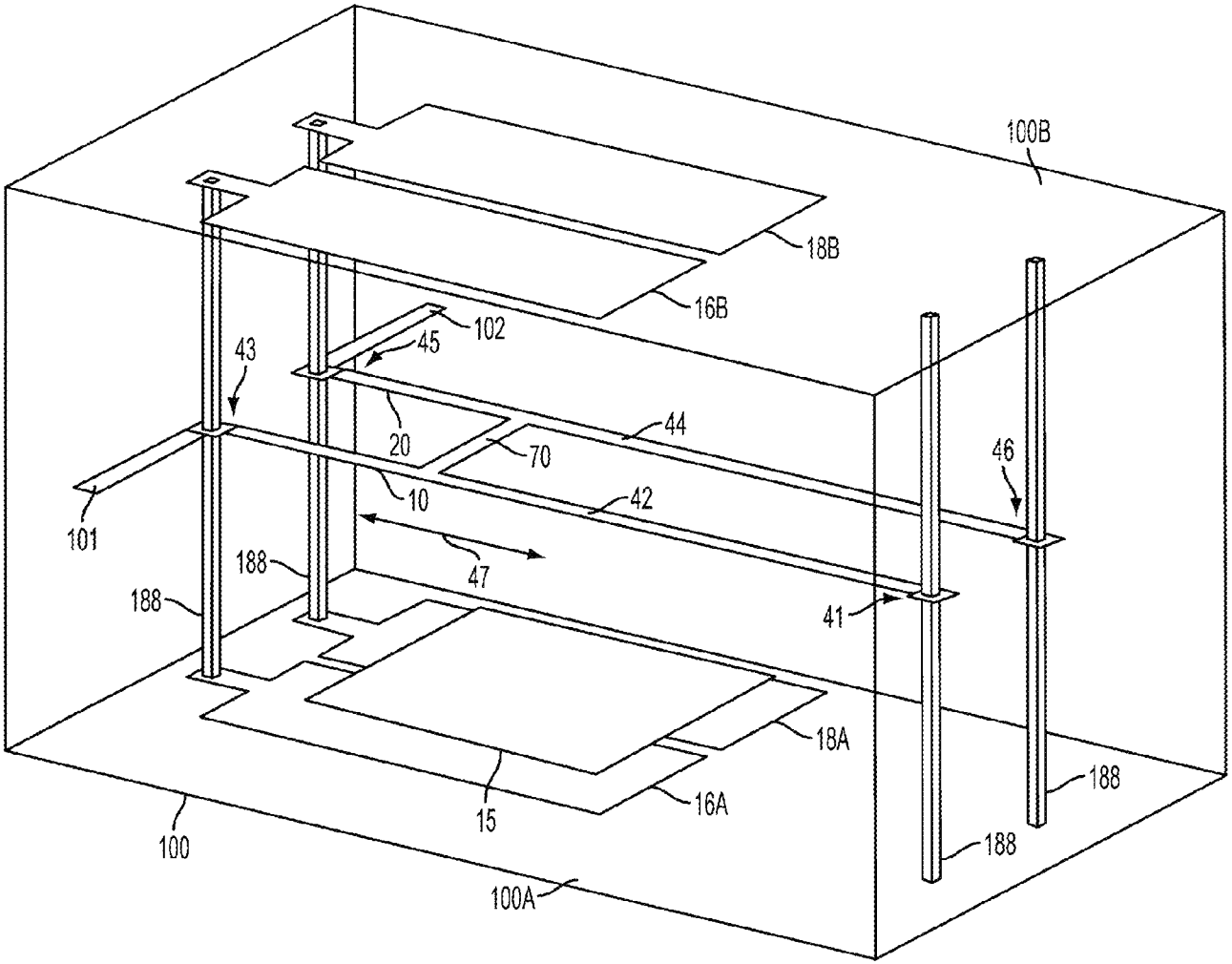
FIG. 6 shows a perspective view of an exemplary implementation of the schematic of FIG. 4 in a multilayer substrate.

FIG. 6 shows a perspective view of an exemplary implementation of the schematic of FIG. 4 in a multilayer substrate. Similarly to FIGS. 1 and 3, layers of the substrates 100 depicted in several drawings are not shown for clarity, but are generally parallel to the bottom surface 100A and top surface 100B of the substrate 100. The resonators 42, 44 are respectively formed from conductive transmission lines configured as transverse electromagnetic quarter-wave resonators residing on the same layer of the substrate 100. The respective short-circuit ends 41, 46 of the resonators 42, 44 are connected to conductive ground vias 188, shown as posts passing vertically through the substrate 100. An input 101 is coupled to the open circuit end 43 of resonator 44, and an output 102 is coupled to the open circuit end 45 of resonator 44. Each of the two resonators 42, 44 is in turn respectively coupled to a ground vias 188 at the respective short circuit ends 41, 46. If desired, input 101 and output 102 may be interchanged.

A strong overcoupling is achieved through an inter-resonator coupling 70 implemented in FIG. 6 as a short transmission lines 70, and is particularly short compared to the length of a quarter wave line in this implementation. Depending on the coupling point chosen either up or down 47 the length of the resonator transmission lines 42, 44, the circuit's frequency response can be adjusted.

Loading capacitors (FIG. 4, 16, 18) are respectively coupled to the resonators 42, 44 through transmission lines 10, 20 to minimize the size of the resonators required to achieve desired frequency response and to achieve other desired performance criteria. The loading capacitors (FIG. 4, 16, 18) are implemented respectively with conductive bottom plates 16A 18A and conductive top plates 16B 18A forming electrodes of capacitors. The material of the substrate provides a dielectric between the plates 16A 16B, 18A 18B respectively defining the capacitors 16, 18. A variety of dielectrics may be utilized to achieve the desired capacitance. The illustrated placement of the plates of the capacitors 16A 16B, 18A 18B around other circuit components such as the resonators 42, 44 minimizes the size of the implemented multiband filter.

An additional coupling capacitor (FIG. 4, 15) is shown implemented in FIG. 6 through a capacitor formed by plate 15 disposed in parallel to plate 16A. As mentioned above, the substrate material forms a dielectric between the respective capacitor plates. Again, by nesting the coupling capacitor within the same substrate volume occupied by the resonators and loading capacitors, the filter component size and cost is minimized.

Figure 7:
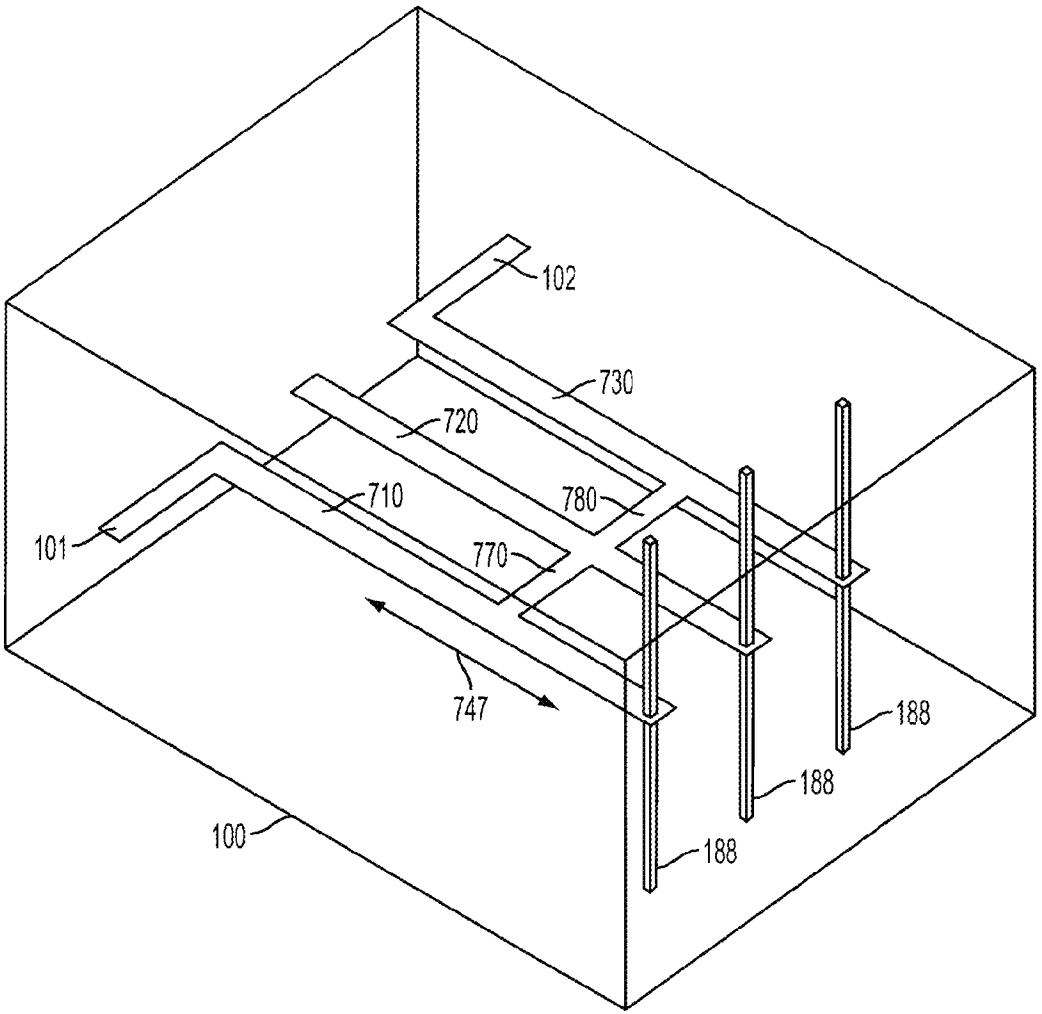
FIG. 7 illustrates a perspective view of an exemplary implementation of a resonator configuration of the present invention in a multilayer substrate.

The two-resonator implementation of the present invention shown in FIGS. 4 and 6 can be adapted to utilize additional resonators to obtain desired filter performance. For example, a three resonator configuration is shown in FIG. 7 (without loading/coupling capacitors and other ground connections shown). The interdigital configuration shown includes three resonators 710, 720, and 730, strongly overcoupled with transmission line inter-resonator couplings 770, 780, where the inter-resonator couplings are much shorter than a quarter-wave line. Additional intra-resonator coupling elements such as capacitors (not shown) may be coupled respectively between resonators to refine the frequency response characteristics of the dual-band filter. Loading capacitors (also not shown) may be coupled to the open-circuit ends of the resonators 710, 720, 730 to optimize design topology. As with previous FIGS. 3 and 6, an interchangeable input 101 and output 102 are respectively coupled to the open circuit ends of resonators 710 and 730. The inter-resonator couplings 770, 780 may be connected at any desired location along the length 747 of the resonators 710, 720, 730.

Figure 8:
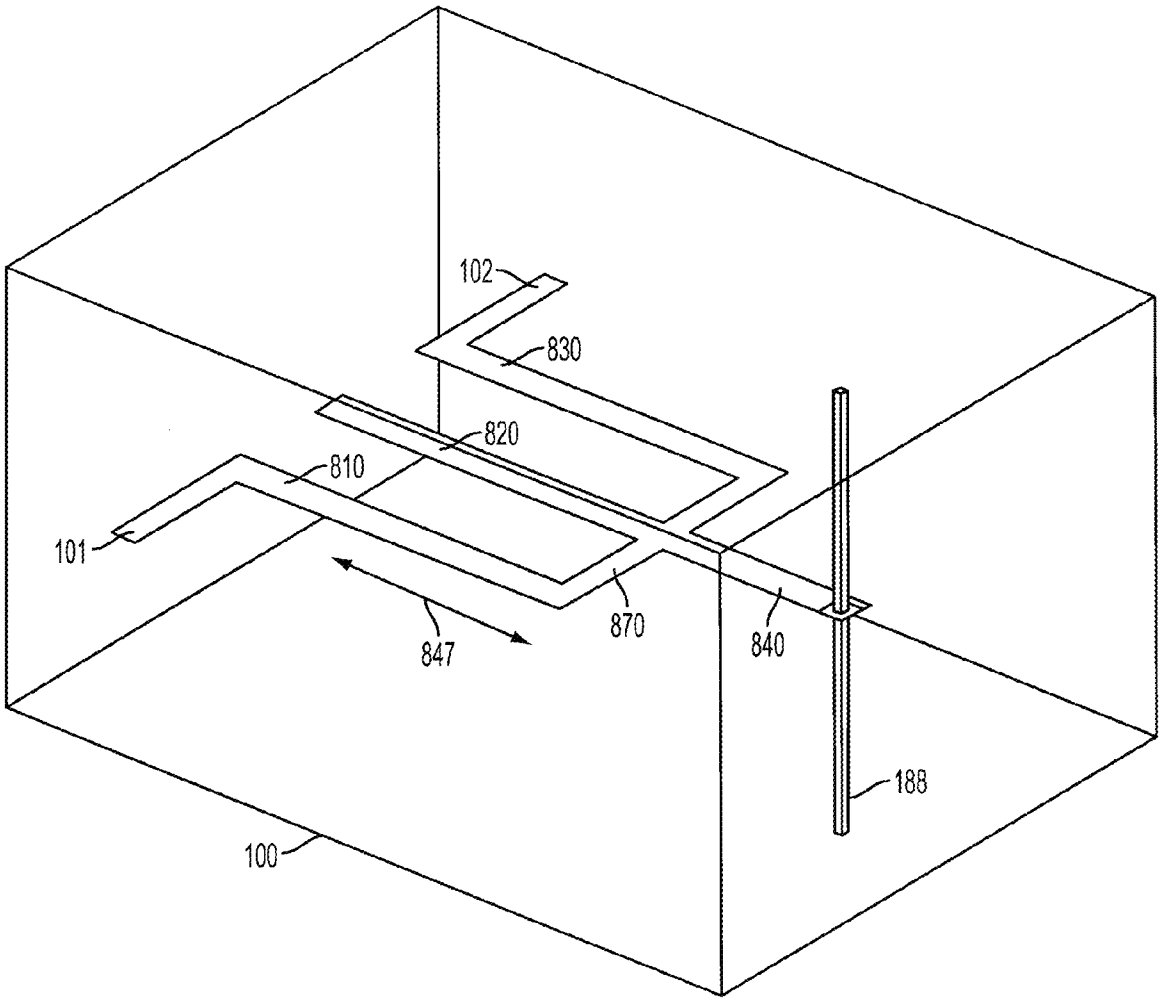
FIG. 8 illustrates a perspective view of an exemplary implementation of a trident resonator configuration of the present invention in a multilayer substrate.

FIG. 8 illustrates yet another resonator configuration that utilizes a trident-shaped topology (without loading/coupling capacitors and other ground connections shown). The exemplary configuration includes three resonators, 810, 820, and 830, strongly overcoupled with transmission line inter-resonator coupling 870 where the inter-resonator coupling is much shorter than a quarter-wave line. Additional intra-resonator coupling elements such as capacitors (not shown) may be coupled respectively between resonators to refine the frequency response characteristics of the dual-band filter. Loading capacitors (also not shown) may be coupled to the open-circuit ends of the resonators 810, 820, 830 to optimize design topology. As with previous FIGS. 3 and 6, an interchangeable input 101 and output 102 are respectively coupled to the open circuit ends of resonators 810 and 830. The inter-resonator coupling 870 may be connected at any desired location along the length 847 of the resonators 810, 820, 830, thereby adjusting the length of the transmission line 840.

Figure 9:
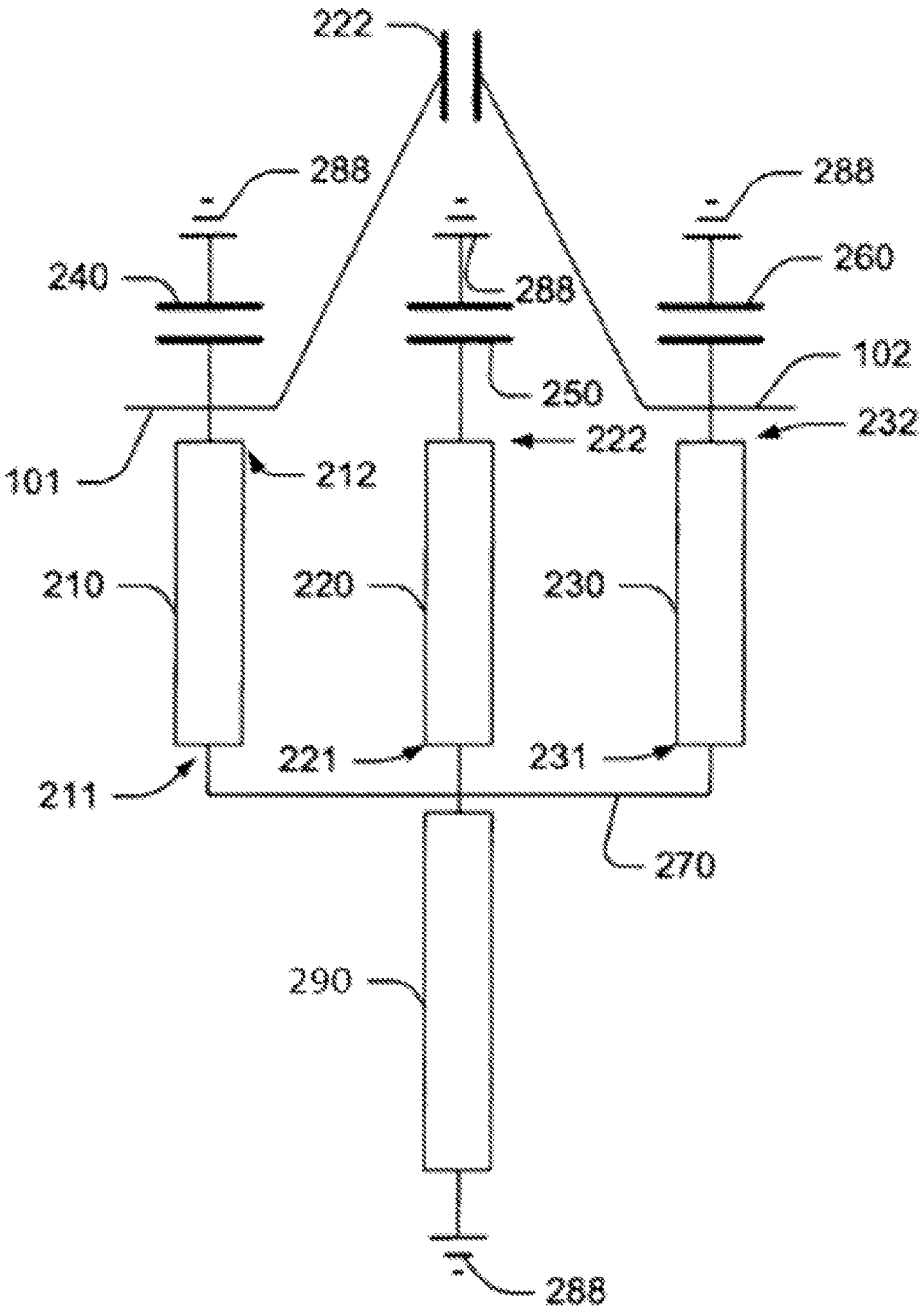
FIG. 9 illustrates a circuit schematic for an embodiment of dual-band filter of the present invention.
Figure 10:
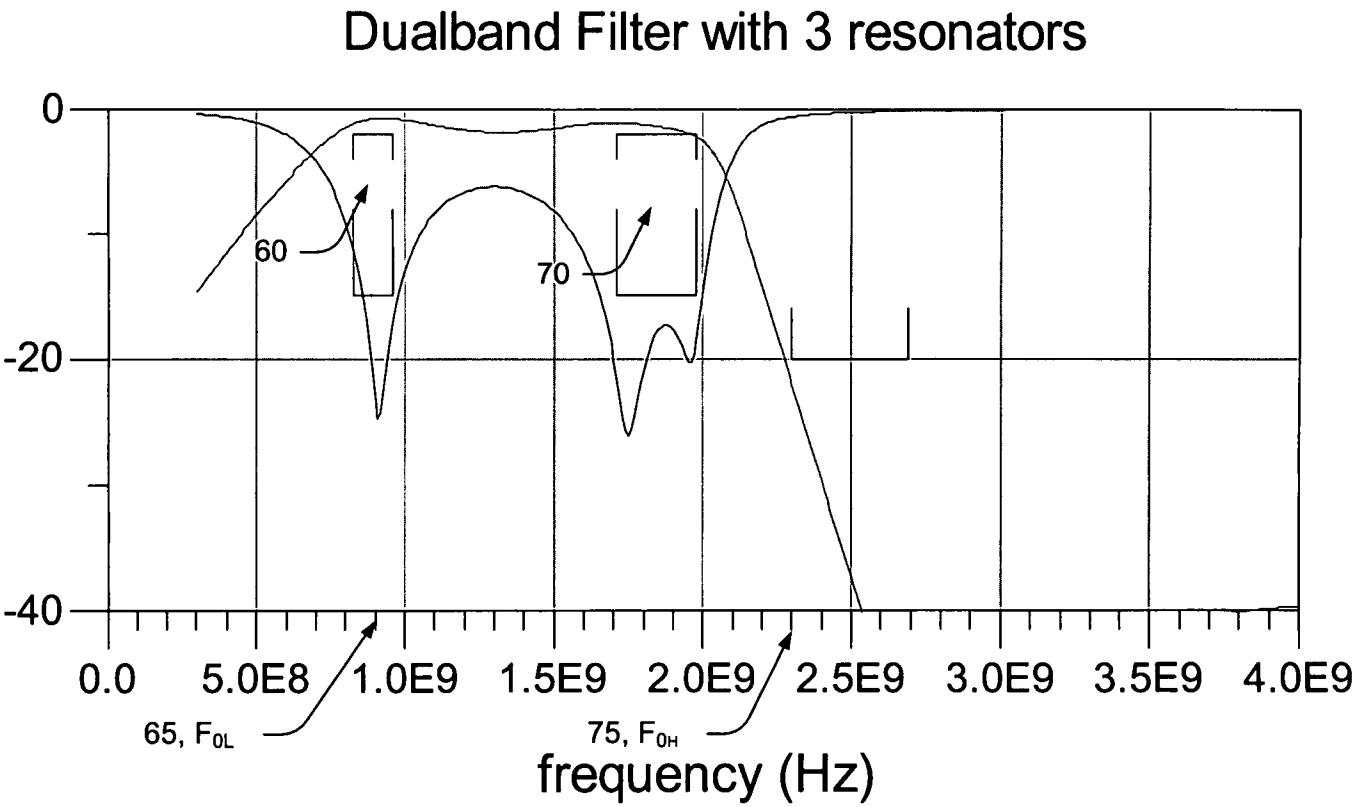
FIG. 10 illustrates a frequency response diagram of the circuit shown in FIG. 9.

FIG. 9 illustrates a schematic of an embodiment of the present invention utilizing the above-mentioned trident resonator topology with a corresponding frequency response diagram illustrated in FIG. 10. The plotted S parameters of FIG. 10 show a dual-band bandpass filter response (60, 70) with center passband frequencies (65, 75) $f_{0L}$ and $f_{0H}$ of approximately 900 and 1800 MHz, respectively. This filter configuration would be useful, for instance, in GSM communications where frequencies outside of the 900 MHz and 1800 MHZ ranges interfere with communications signals.

The embodiment illustrated in the schematic of FIG. 9 includes a filter configuration with three resonators 210, 220, and 230, with an input 101 coupled to the open circuit end 212 of resonator 210, and an output 102 coupled to the open circuit end 232 of resonator 230. Each of the three resonators 210, 220, 230 is in turn respectively coupled to ground at their merge (or short circuit) ends 211, 221, 231. In one embodiment, the resonators 210, 220, 230 may comprise any appropriate resonator structures such as transverse electromagnetic quarter-wave resonators.

The inter-resonator coupling 270 provides strong overcoupling between the resonators 210, 220, and 230. In one embodiment, the intra-resonator coupling comprises a transmission line, where the length of the transmission line is short in comparison to the length of a quarter-wave line. Additional intra-resonator coupling elements such as capacitor 222 (also known as a feedback capacitor) is shown coupled respectively between resonators 210 and 230, and may be utilized to refine the frequency response characteristics of the dual-band filter. Components other than capacitors (inductors, for instance) may be utilized as inter-resonator coupling components depending on the desired frequency response of the filter. A transmission line 290 couples the merge ends 211, 221, 231 to ground.

Loading capacitors 240, 250, and 260 are respectively connected between the open circuit ends 212, 222, 232 of the resonators 210, 220, 230 and ground 288. Among other functions, the loading capacitors help further reduce the size of the transmission lines needed to implement the resonators 210, 220, 230.

Figure 11:
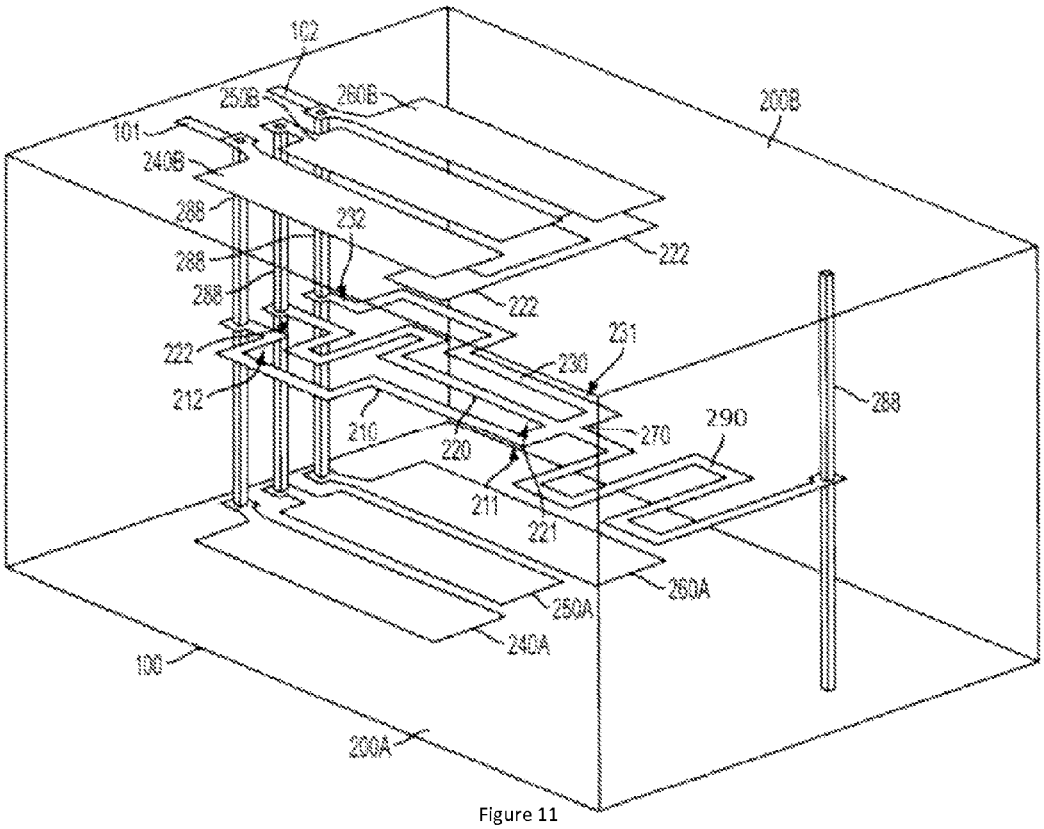
FIG. 11 shows a perspective view of an exemplary implementation of the schematic of FIG. 9 in a multilayer substrate.

FIG. 11 shows a perspective view of an exemplary implementation of the schematic of FIG. 9 in a multilayer substrate such as a low temperature cofired ceramic (LTCC) substrate. Layers of the substrates 100 depicted in several drawings are not shown for clarity, but are generally parallel to the bottom surface 200A and top surface 200B of the substrate 100. The resonators 210, 220, and 230 are respectively formed from conductive transmission lines configured as transverse electromagnetic quarter-wave resonators residing on the same layer of the substrate 100. The resonators 210, 220, 230 are connected to conductive ground vias 288, through a transmission line 290 at their respective merge ends 211, 221, 231. Vias 288 are illustrative of connections to ground, for example to top/bottom ground planes. Ground connections could also be achieved through the use of side wall shielding, built-in coplanar shielding, or any other desired grounding configuration.

A coupling element 270 connects the resonators 210, 220, and 230 with a strong overcoupled connection, and in one embodiment, the coupling comprises a transmission line, where the length of the transmission line is short in comparison to the length of a quarter-wave line. In various embodiments, an additional coupling element may also include one or more capacitors and/or inductors (a coupling capacitor 222 is discussed below). An input 101 is coupled to the open circuit end 212 of resonator 210, and an output 202 is coupled to the open circuit end 232 of resonator 230. If desired, input 201 and output 202 may be interchanged. Transmission line 290 further connects the merge ends 211, 221, 231 of the resonators 210, 220, 230 to ground. The line 290 is shown routed in serpentine manner to further reduce the overall size of the illustrated embodiment.

Loading capacitors (FIG. 9 240, 250, 260) are coupled to the resonators 210, 220, 230 to minimize the size of the resonators required to achieve desired frequency response and to achieve other desired performance criteria. The loading capacitors (FIG. 9 240, 250, 260) are implemented respectively with conductive bottom plates 240A 250A 260A and conductive top plates 240B 250B 260C forming electrodes of capacitors. The material of the substrate provides a dielectric between the plates 240A 240B, 250A 250B, and 260A 260B defining the capacitors 240, 250, 260. A variety of dielectrics may be utilized to achieve the desired capacitance. The illustrated placement of the plates of the capacitors 240A 240B, 250A 250B, and 260A 260B around other circuit components such as the resonators 210, 220, 230 minimizes the size of the implemented multi-passband filter.

An additional coupling capacitor (FIG. 9, 222) is shown implemented in FIG. 11 and is formed by plates 222 disposed in parallel to plate 240B and plate 260B. As mentioned above, the substrate material forms a dielectric between the respective capacitor plates.

Figure 12:
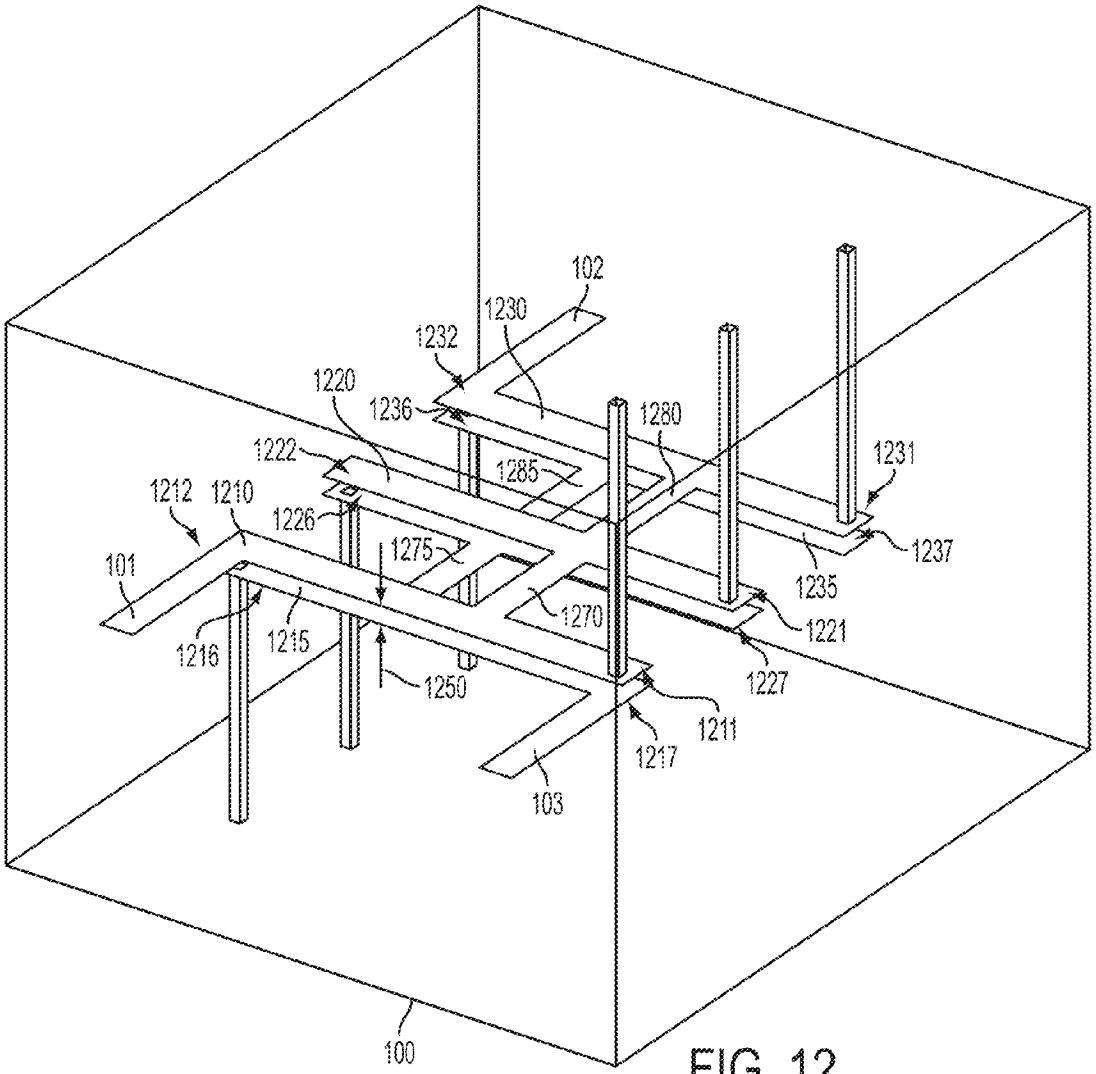
FIG. 12 shows a perspective view of an exemplary implementation of a differential-mode configuration of resonators in a multilayer substrate.

FIG. 12 shows a perspective view of an exemplary implementation of a differential-mode configuration of resonators in a multilayer substrate. Similar to FIGS. 3, 6, 7, 8, and 11, a multi-passband filter is implemented with strongly overcoupled resonators. The resonator configuration shown in FIG. 12, however, includes two overcoupled resonator assemblies—a first assembly of (top) resonators 1210, 1220, 1230, and second assembly (bottom) of resonators 1215, 1225, and 1235. The assemblies are substantially similar in geometry, and in one embodiment, the assemblies are disposed as if the second resonator assembly has a similar topology but displaced vertically 1250 and rotated 180 degrees about a central vertical axis (not shown). As such the resonators 1210, 1220, 1230, are respectively proximate to second assembly (bottom) resonators 1215, 1225, and 1235, except in the apparently rotated alignment shown, the open circuit ends 1212, 1222, 1232 of the first assembly resonators are respectively proximate to the merge ends 1216, 1226, 1236 of the second assembly resonators, and likewise the merge ends 1211, 1221, 1231 of the first resonator assembly are respectively proximate to the open circuit ends 1217, 1227, 1237 of the second resonator assembly. Of note, it can be seen in the illustrated embodiment that coupling elements 1270, 1280 of the first resonator assembly are not proximate the coupling elements 1275, 1285 of the first resonator assembly.

A first input 101 is connected to the open circuit end 1212 of resonator 1210, and a second (differential) input is connected to the open circuit end 1217 of resonator 1215. A common output 102 is connected to the open circuit end 1232 of resonator 1230, and optionally, a second output could be attached to the open circuit end 1237 of the resonator 1235. As those of skill in the relevant arts appreciate, similarly to the embodiments illustrated in FIGS. 3, 6, 7, 8, and 11, additional coupling capacitors and loading capacitors may be similarly implemented with conductive planes in layers above and/or below the resonator layers, and alternative topologies of resonator assemblies may be utilized (e.g. two-resonator configurations, and trident configurations).

Figure 13:
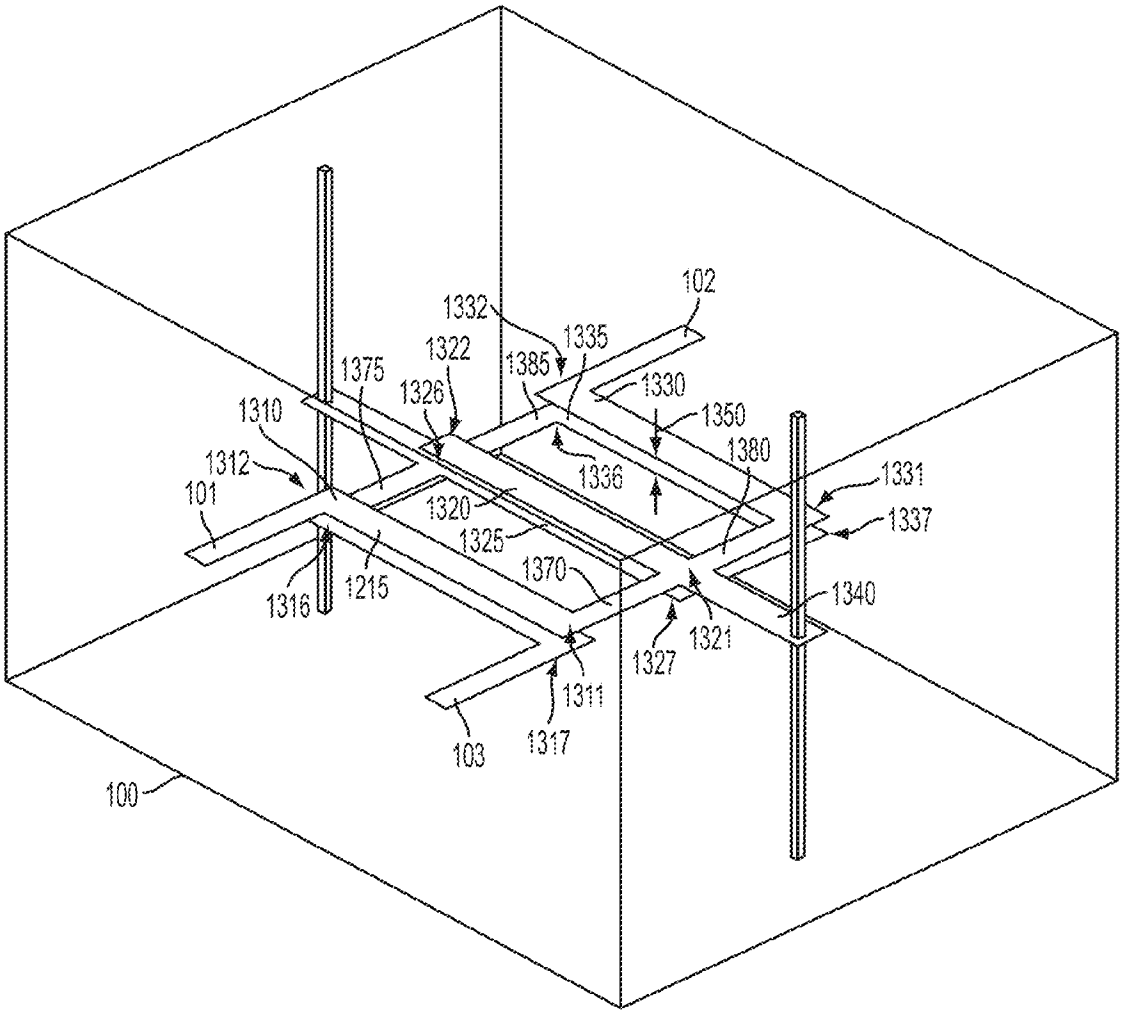
FIG. 13 shows a perspective view of an exemplary implementation of a trident resonator differential-mode configuration of resonators in a multilayer substrate.

FIG. 13 shows a perspective view of an exemplary implementation of a trident resonator differential-mode configuration of resonators in a multilayer substrate. Similar to FIGS. 3, 6, 7, 8, and 11, a multi-passband filter is implemented with strongly overcoupled resonators. The resonator configuration shown in FIG. 13, however, includes two overcoupled resonator assemblies—a first assembly of (top) resonators 1310, 1320, 1330, and second assembly (bottom) of resonators 1315, 1325, and 1335. The assemblies are substantially similar in geometry, and in one embodiment, the assemblies are disposed as if the second resonator assembly has a similar topology but displaced vertically 1350 and rotated 180 degrees about a central vertical axis (not shown). As such the resonators 1310, 1320, 1330, are respectively proximate to second assembly (bottom) resonators 1315, 1325, and 1335, except in the apparently rotated alignment shown, the open circuit ends 1312, 1322, 1332 of the first assembly resonators are respectively proximate to the merge ends 1316, 1326, 1336 of the second assembly resonators, and likewise the merge ends 1311, 1321, 1331 of the first resonator assembly are respectively proximate to the open circuit ends 1317, 1327, 1337 of the second resonator assembly. Of note, it can be seen in the illustrated embodiment that the coupling element 1370, 1380 of the first resonator assembly are not proximate the coupling elements 1275, 1385 of the first resonator assembly.

A first input 101 is connected to the open circuit end 1312 of resonator 1310, and a second (differential) input is connected to the open circuit end 1317 of resonator 1315. A common output 102 is connected to the open circuit end 1332 of resonator 1330, and optionally, a second output could be attached to the open circuit end 1337 of the resonator 1335. As those of skill in the relevant arts appreciate, similarly to the embodiments illustrated in FIGS. 3, 6, 7, 8, and 11, additional coupling capacitors and loading capacitors may be similarly implemented with conductive planes in layers above and/or below the resonator layers, and alternative topologies of resonator assemblies may be utilized.

Other embodiments of the invention will be apparent to those skilled in the art from consideration of the specification and embodiments disclosed herein. Thus, the specification and examples are exemplary only, with the true scope and spirit of the invention set forth in the following claims and legal equivalents thereof.

What is claimed is:

1. A dual-band filter comprising:

a substrate; and first and second resonators disposed within the substrate, each of the first and second resonators respectively having an open circuit end and a short circuit end;

wherein the first and second resonators are connected through a low-reactance inter-resonator coupling, the inter-resonator coupling configuring the filter to provide a dual-band response;

wherein the first and second resonators are over-coupled at their short circuit ends; and wherein the short circuit ends of the first and second resonators are directly connected to ground.

2. The dual-band filter as disclosed in claim 1, wherein the low-reactance inter-resonator coupling comprises a serpentine transmission line co-planar with the first and second resonators.

3. The dual-band filter as disclosed in claim 1 wherein the low-reactance inter-resonator coupling comprises at least one of:

a transmission line substantially shorter than a quarter wavelength;

an inductor;

a capacitor; and a resistor.

4. The dual-band filter as disclosed in claim 2 wherein the low-reactance inter-resonator coupling is coupled between the first and second resonators at any predetermined location along the length of the first and second resonator.

5. The dual-band filter as disclosed in claim 1 wherein the low-reactance inter-resonator coupling is provided by first and second low-reactance inter-resonator coupling components connected to the first and second resonators in parallel.

6. The dual-band filter as disclosed in claim 2 wherein the first and second resonators comprise transverse electromagnetic quarter-wave resonators.

7. The dual-band filter as disclosed in claim 2 wherein each of the first and second resonators respectively comprises one of a combline resonator, an interdigital resonator, and an edge-coupled resonator.

8. The dual-band filter as disclosed in claim 2 wherein the first and second resonators are each respectively loaded by a respective capacitor at the open circuit end, wherein each respective capacitor connects the corresponding first, second, or third resonator to said ground.

9. The dual-band filter as disclosed in claim 2 wherein the substrate comprises at least one of a low temperature co-fired ceramic substrate, a high temperature co-fired ceramic substrate, a silicon substrate, a gallium arsenide substrate, and an organic circuit substrate.

10. The dual-band filter as disclosed in claim 9 wherein the substrate comprises a multilayer structure.

11. The dual-band filter as disclosed in claim 10 wherein the first and second resonators are disposed on a same layer within the multilayer structure, wherein at least one conductive plane on a disparate layer of the multilayer structure configures the circuit as a microstrip architecture.

12. The dual-band filter as disclosed in claim 10 wherein the first and second resonators are disposed on a same layer within the multilayer structure, wherein at least two conductive planes on disparate layers of the multilayer structure configures the circuit as a stripline architecture.

13. The dual-band filter as disclosed in claim 10 wherein:

the first and second resonators are disposed on a same layer within the multilayer structure; and the first and second resonators are respectively coupled to at least one loading capacitor formed by at least one top conductive plane disposed on a layer above the first and second resonators, the at least one top conductive plane situated above at least one lower conductive plane disposed on a layer below the first and second resonators.

14. The dual-band filter as disclosed in claim 1 wherein the low-reactance inter-resonator coupling comprises a common transmission line to ground, the common transmission line coupled between a common tapping of the first and second resonators.

15. The dual-band filter as disclosed in claim 1 further comprising:

a third resonator disposed within the substrate, the third resonator having an open circuit end and a short circuit end;

wherein:

the first, second, and third resonators are connected through said low-reactance inter-resonator coupling, the inter-resonator coupling configuring the filter to provide said dual-band response;

the low-reactance inter-resonator coupling component comprises a common transmission line to said ground, the common transmission line coupled between a common tapping of the first, second, and third resonators;

the first, second and third resonators are each respectively loaded by a respective capacitor at the open circuit end, wherein each respective capacitor connects the respective first, second, or third resonator to said ground.

16. The dual-band filter as disclosed in claim 15 further comprising a feedback capacitor coupled between open circuit ends of at least two of the first, second, and third resonators.

* * * * *